United States Patent [19]

Mizuma

[11] Patent Number: 4,586,324

[45] Date of Patent: May 6, 1986

[54] METAL CORD FOR REINFORCING RUBBER PRODUCTS

[75] Inventor: Kaoru Mizuma, Kitakami, Japan

[73] Assignee: Tokyo Rope Mfg. Co., Ltd., Tokyo, Japan

[21] Appl. No.: 687,633

[22] Filed: Dec. 31, 1984

[51] Int. Cl.[4] ..... D02G 3/48; D07B 1/06; B60C 9/00

[52] U.S. Cl. ..... 57/212; 57/223; 57/902; 152/451

[58] Field of Search ..... 57/212, 213, 217, 218, 57/221, 223, 902; 152/356, 359, 361 R

[56] References Cited

U.S. PATENT DOCUMENTS

| | | | |
|---|---|---|---|
| 3,032,963 | 5/1962 | Fenner | 57/212 X |
| 3,538,702 | 11/1970 | Wolf et al. | 57/902 X |
| 3,762,145 | 10/1973 | Kikuchi et al. | 57/218 |
| 3,834,149 | 9/1974 | Nisbet | 57/217 X |
| 3,911,662 | 10/1975 | Fenner | 57/223 X |
| 4,022,009 | 5/1977 | Van Assendelft | 57/212 |
| 4,030,248 | 6/1977 | Van Assendelft | 57/212 X |
| 4,158,946 | 6/1979 | Bourgois | 57/213 |
| 4,258,543 | 3/1981 | Canevari et al. | 57/212 |
| 4,399,853 | 8/1983 | Morimoto et al. | 152/359 |
| 4,408,444 | 10/1983 | Baillievier | 57/902 X |
| 4,464,892 | 8/1984 | Kleijwegt | 57/212 |
| 4,506,500 | 3/1985 | Miyauchi et al. | 57/212 |
| 4,509,318 | 4/1985 | Yoneda | 57/212 |
| 4,516,395 | 5/1985 | Palmer et al. | 57/902 X |
| 4,545,190 | 10/1985 | Rye et al. | 57/212 |

*Primary Examiner*—John Petrakes

*Attorney, Agent, or Firm*—Frishauf, Holtz, Goodman & Woodward

[57] ABSTRACT

A metal cord used as a reinforcement for rubber products. The cord includes a strand core composed of a plurality of metal wires stranded with each other. A plurality of metal wires are stranded around the strand core, forming a strand layer. The number of the metal wires which form the strand layer is less than 4 plus the number of the metal wires which form the strand core, and each of the metal wires which form both the strand core and layer has substantially the same diameter.

8 Claims, 4 Drawing Figures

FIG. 1
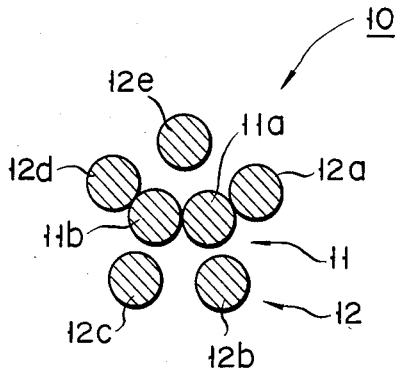
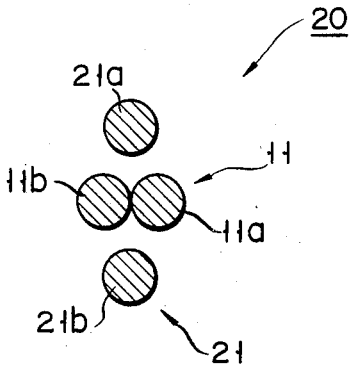
FIG. 2
FIG. 3
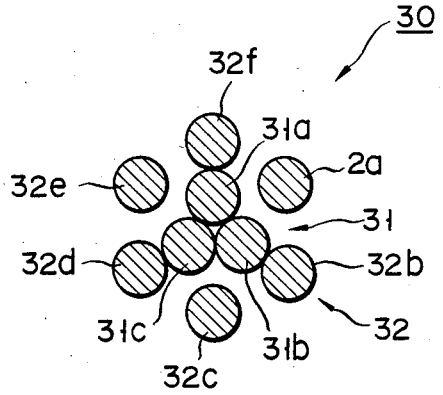

METAL CORD FOR REINFORCING RUBBER PRODUCTS

BACKGROUND OF THE INVENTION

The present invention relates to a metal cord suitable for being used as a reinforecment for rubber products such as tires and, more particularly, it relates to a metal cord with a double-layered structure.

Metal cords such as steel cords, for example, which have been conventionally used as reinforcements for rubber products such as tires, for example, are of the single-layered strand type, multi-layered strand type, complex (or cable) type, or the like, and these are made by stranding wires each having a diameter of about 0.15 mm to 0.38 mm. The wires which form these cords are usually stranded to closely contact one another, and the cords thus formed can be called the compact type.

In the case of the conventional cords of the compact type, the wires closely contact one another, as described above. Even when they are used for reinforcing rubber products, therefore, rubber cannot enter them but only cover their surface. In a case where damage occurs to the rubber portion of the rubber product and reaches the cord therein, for example, in reinforced rubber products such as tires, water reaches the inside of the cord through this damaged portion to corrode the wires, or finally break the tire itself.

In order to overcome this drawback, U.S. Pat. No. 4,258,543 discloses a metal cord of the single strand type wherein wires are separated from one another to become larger than the outer diameter of the cord of the compact type. Further, U.S. Pat. No. 4,022,009 discloses a cable constructed by aligning plural wires parallel to one another, stranding the whole of these aligned wires at a long pitch to form a core, and winding a wire around this core. In the case of these cords and cables disclosed by U.S. Patents, the wires relatively loosely contact one another. Therefore, rubber can easily enter the wires, thereby enabling the rubber product to be reinforced and the wires to be sufficiently enclosed by rubber. However, these cords are relatively unstable in construction and inferior in durability.

SUMMARY OF THE INVENTION

The object of the present invention is therefore to provide a metal cord excellent in rubber penetrability, constructive stability and durability.

The metal cord of the present invention comprises a strand core made by stranding a plurality of metal wires, and a strand layer formed around the strand core. This strand layer is formed by stranding a plurality of metal wires. The number of metal wires which form the strand layer is less than 4 plus the number of the metal wires which form the strand core, and these metal wires which form both the core and layer strands have the same diameter. The metal cord of the present invention, which comprises the core and layer strands, can be called a double-layered type.

BRIEF DESCRIPTION OF THE DRAWINGS

FIG. 1 is a sectional view showing an example of the metal cord according to the present invention;

FIG. 2 is a sectional view showing another example of the metal cord according to the present invention;

FIG. 3 is a sectional view showing a further example of the metal cord according to the present invention.

DETAILED DESCRIPTION OF THE PREFERRED EMBODIMENT

Figure 4:
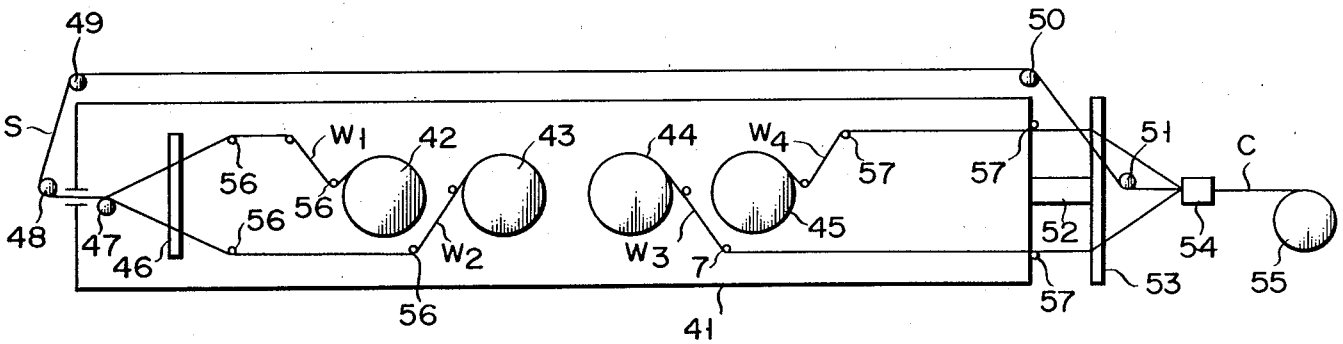
FIG. 4 is a rough sketch showing an apparatus suitable for use in preparing the metal cord of the present invention.

As described above, the metal cord of the present invention is made by metal wires each having substantially the same diameter. The diameter of each of the metal wires usually ranges from 0.15 mm to 0.45 mm. Providing that the number of the metal wires which form the strand core is represented by $N_0$ ($\geqq 2$) and that the number of the metal wires which comprise the strand layer formed around the strand core is denoted by $N_1$ ($\geqq 2$), $$N_1 \leqq N_0 + 4$$

Namely, providing that the various wires forming the strand core have the same diameter in the standard metal cord of the compact type and of the plural-layered strand type, the number of wires is represented by $N_C$, and the number of wires which comprise the strand layer formed round the strand core is $N_c+6$, and the wires closely contact one another under this condition. When the number of the wires which form the strand core is 2 in the case of the standard metal cord of the compact type, for example, the number of the wires comprising the strand layer becomes 8 ($=2+6$). In the metal cord of the present invention, however, the number of the metal wires comprising the strand layer is less by 2 or more than the number of the wires which comprise the strand layer in the case of the standard metal cord of the compact type, as apparent from the above.

The present invention will be described in more detail with reference to the accompanying drawings, in which the same parts are denoted by the same reference numerals.

FIG. 1 is a sectional view showing an example of the metal cord according to the present invention. This metal cord 10 has a core strand 11 made by stranding two metal wires, particularly brass-plated steel wires 11*a* and 11*b* each having same diameter. These wires 11*a* and 11*b*, which form the strand core, are stranded at a pitch of 30 mm to 15 mm, for example. Five metal wires, particularly brass-plated steel wires 12*a*, 12*b*, 12*c*, 12*d* and 12*e* each having the same diameter as those of the wires 11*a* and 11*b*, are stranded around the strand core 11 at a strand pitch two times that in the case of the wires 11*a* and 11*b* to thereby form a strand layer 12. The metal cord of the double-layered construction ($1\times2+5$) is thus formed.

The number of the wires which form the strand layer 12 of the metal cord shown in FIG. 1 is 5, or 3 less than that in the case of the commercially-available metal cord of the compact type. Therefore, the wires 12*a* . . . 12*e* which form the strand layer 12 are not in close contact with one another, thus leaving clearance among them so the penetrability of the rubber can be more highly enhanced, compared to the standard metal cord of the compact type, and higher durability can be obtained relative to corrosion caused by water and the like. In addition, the construction of the metal cord according to the present invention is the same as that of the standard compact type except that the number of the wires which form the strand layer is less. Therefore, the metal cord of the present invention is better in structural stability than the conventional metal cord of the loose lay construction.

FIG. 2 is a sectional view showing a second example of the metal cord according to the present invention. This metal cord 20 has the same strand core 11 as that of the metal cord shown in FIG. 1. Two steel wires 21*a* and 21*b* are stranded around the strand core at a pitch two times that of the wires 11*a* and 11*b* to thereby form a strand layer 21. Each of the wires 21*a* and 21*b* has the same diameter as those of the wires 11*a* and 11*b*. This metal cord has a construction of (1×2+2), accordingly.

FIG. 3 is a sectional view showing a third example of the metal cord according to the present invention. This metal cord 30 has a strand core 31 made by stranding three steel wires 31*a*, 31*b* and 31*c* having the same diameter. The strand pitch of the wires 31*a*, 31*b*and 31*c* ranges from 5.0 mm to 18 mm, for example. Six steel wires 32*a*, 32*b*, 32*c*, 32*d*, 32*e* and 32*f* each having the same diameter as those of the wires 31*a*, 31*b* and 31*c* are stranded around the strand core 31 at a pitch two times that of the wires 31*a*, 31*b* and 31*c* to thereby form a strand layer 32. This metal cord 30 has a construction of (1×3+6), accordingly.

The metal cords shown in FIGS. 2 and 3 can achieve the same effects as those attained by the metal cord 10 shown in FIG. 1.

The following table shows test results of the durability relating to the metal cords of the present invention and the conventional ones. In the table, Nos. 1 and 2 represent the steel cords of the present invention, Nos. 3 and 4 represent standard compact steel cords of the single strand type, and No. 5 represents the steel cord of U.S. Pat. No. 4,022,009 wherein four steel wires are aligned parallel to one another and slightly stranded to form a strand core and a steel wire is wound around this strand core. Each of the wires had a diameter of 0.25 mm in all of these steel cords. Hunter (Rotating Beam Fatigue) test results represent fatigue limits by fatigue index, 3-Roller Bending Fatigue Test results represent the number of times by which breaking is caused, and De-Mattia Fatigue test results represent residual breaking load after the load is added 15,000 times at a stroke of 60 mm according to ASTM D2969-79. Breaking load tests were conducted according to ASTM D 2969-79, and elongation under low load (0.27–1.63 Kg) test according to the ASTM D 2969-79. Air permeability test was conducted such that a vulcanized rubber piece embedded with the cord by 12.7 mm was immersed in a water tank at a depth of about 5 cm, and air was forced to the bottom of the rubber piece at 0.5 Kgf/cm$^2$. The amount of air penetrated through the rubber piece was measured by a messcylinder.

Nos. 3 and 4 of the standard type, while the steel cords Nos. 1 and 2 of the present invention have substantially the same durability as those of the steel cords of the standard type.

The above-described metal cord of the present invention can be prepared by various methods, and it should be understood that the present invention is not limited in its manufacturing method.

However, a method most suitable for manufacturing the metal cord of the present invention uses a stranding apparatus shown in FIG. 4. The method of manufacturing the metal cord of the present invention, which has the structure of (1×2+2), will be described using the stranding apparatus. The stranding apparatus 40 shown in FIG. 4 has a tube 41 supported to be freely rotatable. Four bobbins 42, 43, 44 and 45 are housed and held inside the tube 41 through a cradle (not shown), which is always stationary regardless of the rotation of the tube 41. Metal wires $W_1$ and $W_2$ which form the strand core are wound around the bobbins 42 and 43. Wires $W_3$ and $W_4$ which form the strand layer are wound around the bobbins 44 and 45.

A wire guide plate 46, which is always held stationary regardless of the rotation of the tube 41 and similar to the case of the cradle, and a collecting roll 47 are housed inside the tube 41 between the bobbin 42 and one end of the tube 41. The guide plate 46 has through-holes (not shown) which correspond to the number (two in this case) of wires which form the strand core. The collecting roll 47 is positioned between the guide plate 46 and the one end of the tube 41. Strand guiding rolls 48 and 49, which are rotated together with the tube 41, are located outside the tube 41 adjacent to and above the collecting roll 47.

A wire guiding plate 53 is fixed to the outer face of the other end of the tube through a support shaft 52 concentric with the center axis of the tube 41. The wire guiding plate 53 has through-holes (not shown) which correspond to the number (two in this case) of the wires which form the strand layer.

Strand guiding rolls 50 and 51, similar to the guide rolls 49 and 48, are located above the other end of the tube 41 and outside the guide plate 53, respectively. A stranding die 54, concentric with the center axis of the tube 41, is located in front of the guide roll 51, and a capstan 55 is located in front of the strand die 54. The capstan 55 is also arranged concentric with the center axis of the tube 41.

The strand core wires $W_1$ and $W_2$ wound around the bobbins 42 and 43 are passed through the guide plate 46 via their guide chips 56, guided to and wound one time around the collecting roll 47, and then wound around the capstan 55, passing the strand guiding rolls 48, 49, 50, 51 and strand die 54 in this order. On the other hand, the layer strand wires $W_3$ and $W_4$ wound around the bobbins 44 and 45 are passed through the guide plate 53

TABLE

| Sample No. | Structure | Diameter of the Cord (mm) | Breaking Load (Kg) | Durability Hunter | Durability 3-Roller times | Durability De-Mattia (%) | Air Permeated (ml/minute) | Elongation Under Low Load $\bar{x}$ (%) | Elongation Under Low Load SD (%) |
|---|---|---|---|---|---|---|---|---|---|
| 1 | 1 × 2 + 2 | 0.65 | 54 | 80 | 10.272 | 91 | 0 | 0.034 | 0.0018 |
| 2 | 1 × 2 + 3 | 0.75 | 66 | 85 | 11.428 | 97 | 0 | 0.032 | 0.0019 |
| 3 | 1 × 4 | 0.60 | 55 | 80 | 9.903 | 71 | 80 | 0.035 | 0.0022 |
| 4 | 1 × 5 | 0.67 | 66 | 90 | 10.133 | 86 | 360 | 0.040 | 0.0021 |
| 5 | 3 + 1 | 0.60 | 54 | 25 | 7.418 | 28 | 0 | 0.030 | 0.0016 |

As apparent from the above table, the conventional steel cord No. 5 is substantially inferior in durability to via their guide chips 57, and wound around the capstan 55 through the strand die 54.

Under this condition, the tube 41 is rotated one turn and the wires $W_1$, $W_2$, $W_3$ and W4 are successively taken up by the capstan 55. The strand core wires $W_1$ and $W_2$ pulled out of the bobbins 42 and 43 are stranded the first time between the collecting roll 47 and the guide roll 48 to form the strand core S, which is stranded the second time between the guide roll 51 and the strand die 54 when it passes through the strand die 54.

On the other hand, the layer strand wires $W_3$ and $W_4$ pulled out of the bobbins 44 and 45 are stranded around the strand core S while they are being stranded between the guide plate 53 and the strand die 54. A metal cord C of the present invention is thus pulled out through the strand die 54 and wound around the capstan 55. This metal cord has a structure of $(1\times2+2)$.

As apparent from the above, the wires $W_1$ and $W_2$, which form the strand core S, are stranded two times, while the wires $W_3$ and $W_4$, which form the strand layer, are stranded one time. Therefore, the strand pitch of the wires which form the strand layer becomes two times that of the wires which form the strand core. Although the method of manufacturing the metal cord which has the structure of $(1\times2+2)$ has been described, a metal cord which has other structures according to the present invention can be manufactured by quite the same method, using bobbins which correspond to the number of wires which are to form the strand core, bobbins which correspond to the number of wires which are to form the strand layer, and guide plates one of which has through-holes corresponding to the number of strand core wires and the other of which has through-holes corresponding to the number of strand layer wires.

As described above, the present invention can provide a metal cord excellent in rubber penetrability and constructive stability and capable of being kept relatively slight in durability deterioration. Although metal cords which have the structures of $(1\times2+5)$, $(1\times2+2)$, $(1\times2+3)$ and $(1\times3+6)$ have been described above, the present invention is not limited to metal cords of these structures, but it can be applied to metal cords of all double-layered structures wherein wires having the same diameter are employed, and the number of wires which form the strand layer is at least two less than the wires which form the strand layer of the compact type metal cord. Thus, the metal cord which has a structure of $(1\times2+4)$, $(1\times2+6)$, or $(1\times3+7)$, for example, is included in the scope of the present invention.

What is claimed is:

1. A metal cord for use as a reinforcement for rubber products, comprising:

a strand core comprising a plurality of metal wires stranded with eath other; and a strand layer comprising a plurality of metal wires stranded around the strand core, the wires forming the strand layer being stranded at a pitch two times that of the wires which form the strand core;

wherein the number of the metal wires which form the strand layer is less than 4 plus the number of the metal wires which form the strand core, and wherein each of the metal wires which form both the strand core and layer has substantially the same diameter, so that a space is provided between the wires forming the strand layer for enabling rubber permeability of the cord.

2. A metal cord according to claim 1, wherein the number of the wires which form the strand core is 2 and the number of the wires which form the strand layer is 2.

3. A metal cord according to claim 1, wherein the number of the wires which form the strand core is 2 and the number of the wires which form the strand layer is 3.

4. A metal cord according to claim 1, wherein the number of the wires which form the strand core is 2 and the number of the wires which form the strand layer is 5.

5. A metal cord according to claim 1, wherein the number of the wires which form the strand core is 3 and the number of the wires which form the strand layer is 6.

6. A metal cord according to claim 1, wherein the metal wires are made of steel.

7. A metal cord according to claim 6, wherein each of the wires is brass-plated.

8. A metal cord according to claim 1, wherein the strand pitch of the strand core is in the range of from 3.0 mm to 18.0 mm.

* * * * *